US010933955B2

(12) United States Patent
Poindexter et al.

(10) Patent No.: US 10,933,955 B2
(45) Date of Patent: Mar. 2, 2021

(54) CRUDE OIL CARGO RECIRCULATION SYSTEM

(71) Applicant: American Commercial Lines LLC, Jeffersonville, IN (US)

(72) Inventors: Michael Poindexter, Otisco, IN (US); Dave Cooley, Louisville, KY (US); Raymond Aubrey, Sonora, KY (US)

(73) Assignee: AMERICAN COMMERCIAL BARGE LINE LLC, Jeffersonville, IN (US)

( * ) Notice: Subject to any disclaimer, the term of this patent is extended or adjusted under 35 U.S.C. 154(b) by 267 days.

(21) Appl. No.: 14/320,905

(22) Filed: Jul. 1, 2014

(65) Prior Publication Data

US 2015/0007892 A1 Jan. 8, 2015

Related U.S. Application Data

(60) Provisional application No. 61/842,702, filed on Jul. 3, 2013.

(51) Int. Cl.
*B63B 25/12* (2006.01)
*F17D 5/00* (2006.01)

(52) U.S. Cl.
CPC ..... *B63B 25/12* (2013.01); *F17D 5/00* (2013.01); *Y10T 137/0318* (2015.04); *Y10T 137/8326* (2015.04); *Y10T 137/85954* (2015.04)

(58) Field of Classification Search
CPC ..... B63B 57/02; B63B 13/00; F17D 5/00
USPC ..... 137/255–267, 561, 563, 565.12, 899.2; 114/74 R, 256
See application file for complete search history.

(56) References Cited

U.S. PATENT DOCUMENTS

| | | | | | |
|---|---|---|---|---|---|
| 1,472,238 | A * | 10/1923 | Berkey | 162/100 | |
| 1,713,657 | A * | 5/1929 | Hogan | 422/113 | |
| 2,314,555 | A * | 3/1943 | Preuss | 114/74 R | |
| 3,362,370 | A * | 1/1968 | Morrell | 114/74 R | |
| 3,631,832 | A * | 1/1972 | Rodriguez | B63B 25/10 114/74 R | |
| 3,844,239 | A * | 10/1974 | McLaughlin et al. | 114/74 R | |
| 3,897,807 | A * | 8/1975 | Hurst et al. | 141/98 | |
| 3,926,135 | A * | 12/1975 | De Gregorio | 114/74 R | |
| 4,389,959 | A * | 6/1983 | Conway | 114/74 R | |
| 4,446,804 | A * | 5/1984 | Kristiansen et al. | 114/74 R | |
| 5,897,767 | A * | 4/1999 | Patel | C10G 33/04 208/13 | |
| 6,345,672 | B1 * | 2/2002 | Dietzen | B63B 27/20 175/206 | |
| 6,712,895 | B1 * | 3/2004 | Hoad | 106/122 | |
| 2013/0150268 | A1 * | 6/2013 | Oldham | C09K 8/62 507/215 | |

* cited by examiner

*Primary Examiner* — Angelisa L. Hicks
(74) *Attorney, Agent, or Firm* — Frost Brown Todd LLC

(57) ABSTRACT

A recirculation system for a crude oil cargo tank barge having at least one tank includes a pump in fluid communication with at least one tank and recirculation piping in fluid communication with the pump and at least one tank. The pump pumps fluid from at least one tank to the recirculation piping. The recirculation piping then returns the pumped fluid to at least one tank.

20 Claims, 7 Drawing Sheets

CRUDE OIL CARGO RECIRCULATION SYSTEM

PRIORITY

This application claims priority to U.S. Provisional Patent Application Ser. No. 61/842,702, filed Jul. 3, 2013, entitled "Crude Oil Cargo Recirculation System," the disclosure of which is incorporated by reference herein.

BACKGROUND

Crude oil tank barges typically include at least one cargo tank designed to store and transport crude oil. During the use of these tanks, wax, asphaltic deposits, sediment, and other material may build up within the tanks and lessen the capacity of the tanks to store cargo. Accordingly, it may be desirable to decrease and/or remove the build-up from within the cargo tanks. One method of removing such build-up includes Crude Oil Washing (COW), where the crude oil cargo itself is used to wash the tanks after the tanks have been emptied. This method includes emptying the tanks, heating the crude oil, and then spraying the crude oil onto the walls and floors of the tanks via high pressure nozzles. It is desirable to minimize or eliminate the need for this task. As such, there is a need for improved methods for decreasing the amount of build-up within crude oil tanks.

BRIEF DESCRIPTION OF THE DRAWINGS

While the specification concludes with claims that particularly point out and distinctly claim the invention, it is believed the present invention will be better understood from the following description of certain examples taken in conjunction with the accompanying drawings. In the drawings like reference numerals identify the same elements. Hatching in sections views has been omitted where such hatching would detract from the legibility of the drawing. Hatching that is included only provides indication of sectioned portions generally, and the materials of construction for the object shown are not required to be, or limited to, any material type conveyed by the style of hatching used.

Figure 1:
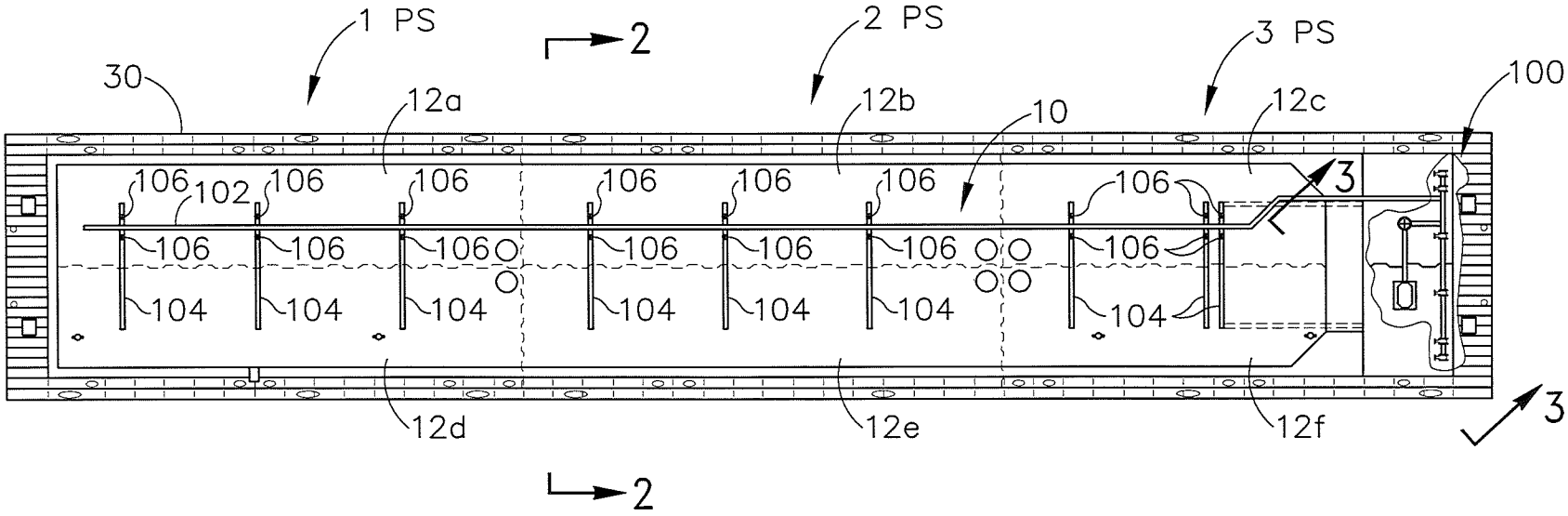
FIG. 1 depicts a top plan view of an example crude oil tank barge including a crude oil cargo recirculation system.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. For example, those of ordinary skill in the art will realize that there are a number of techniques that can be used in designing an exemplary crude oil cargo recirculation system for use with a crude oil tank barge. Many of these techniques are described herein, and still others will be apparent to those of ordinary skill in the art based on the teachings herein. The teachings herein with regard to these techniques can be applied to any number of exemplary crude oil cargo recirculation systems, and not solely the exemplary crude oil cargo recirculation system discussed in the context of the technique being described. Furthermore any number of these techniques can be combined in designing a crude oil cargo recirculation system. Accordingly, the drawings and descriptions should be regarded as illustrative in nature and not limiting.

After a brief discussion of some functional considerations and features regarding crude oil cargo recirculation systems for use with a crude oil tank barge, subsequent sections describe some exemplary operations for some exemplary crude oil cargo recirculation systems.

During transit of crude oil within a tank barge, material can settle from the crude oil and build up within the tank barge. In an effort to minimize such settling, a system was developed to recirculate the crude oil cargo to thereby resuspend material settled within the tank barge. In this way, material within the crude oil stays suspended to prevent build up within the tank barge. The system can be retrofitted onto existing tank barges, or the system can be incorporated into newly built tank barges. The system generally comprises a longitudinal header (102) and recirculation headers (104) that couple crude oil tanks with a pumping unit (100) used to unload the crude oil cargo and to recirculate the crude oil cargo within the tanks.

I. Example Crude Oil Cargo Recirculation System

FIG. 1 shows an example crude oil tank barge (30) including a crude oil cargo recirculation system (10). Tank barge (30) comprises a plurality of tanks (12), which include independent compartments used to store and transport crude oil cargo on tank barge (30). FIG. 1 shows tank barge (30) having six tanks (12) arranged with three starboard tanks (12*a*, 12*b*, 12*c*) and three port tanks (12*d*, 12*e*, 12*f*). Accordingly, tanks (12*a*, 12*d*) comprise a first lateral row of tanks (1PS), tanks (12*b*, 12*e*) comprise a second lateral row of tanks (2PS), and tanks (12*c*, 12*d*) comprise a third lateral row of tanks (3PS). Alternatively, tank barge (30) can include any other suitable number of tanks (12). For instance, in some versions, tank barge (30) further includes center tanks such that each lateral row of tanks (1PS, 2PS, 3PS) includes three tanks (12). Tanks (12) can be similar in size or vary in size. For example, tanks (12*a*, 12*d*) can be about 95 feet 6 inches in length, tanks (12*b*, 12*e*) can be about 96 feet in length, and tanks (12*c*, 12*f*) can be about 90 feet long such that tank barge (30) is about 297 feet 6 inches in length. The width of the interior portion of each lateral row of tanks (1PS, 2PS, 3PS) can be about 45 feet. Of course, other suitable configurations for tank barge (30) and/or tanks (12) will be apparent to one with ordinary skill in the art in view of the teachings herein.

Figure 2:
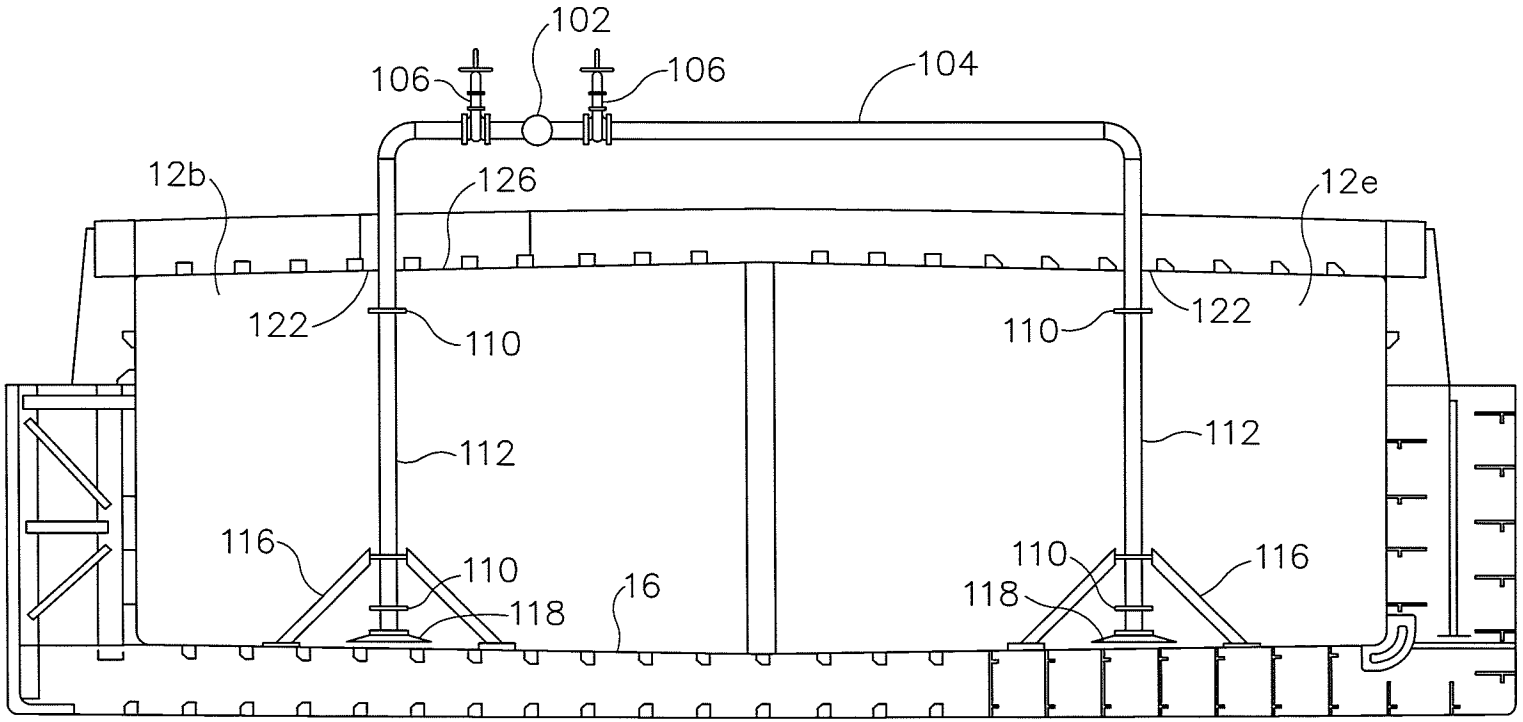
FIG. 2 depicts a cross-sectional view of the crude oil tank barge of FIG. 1 taken along line 2-2 of FIG. 1.
Figure 4:
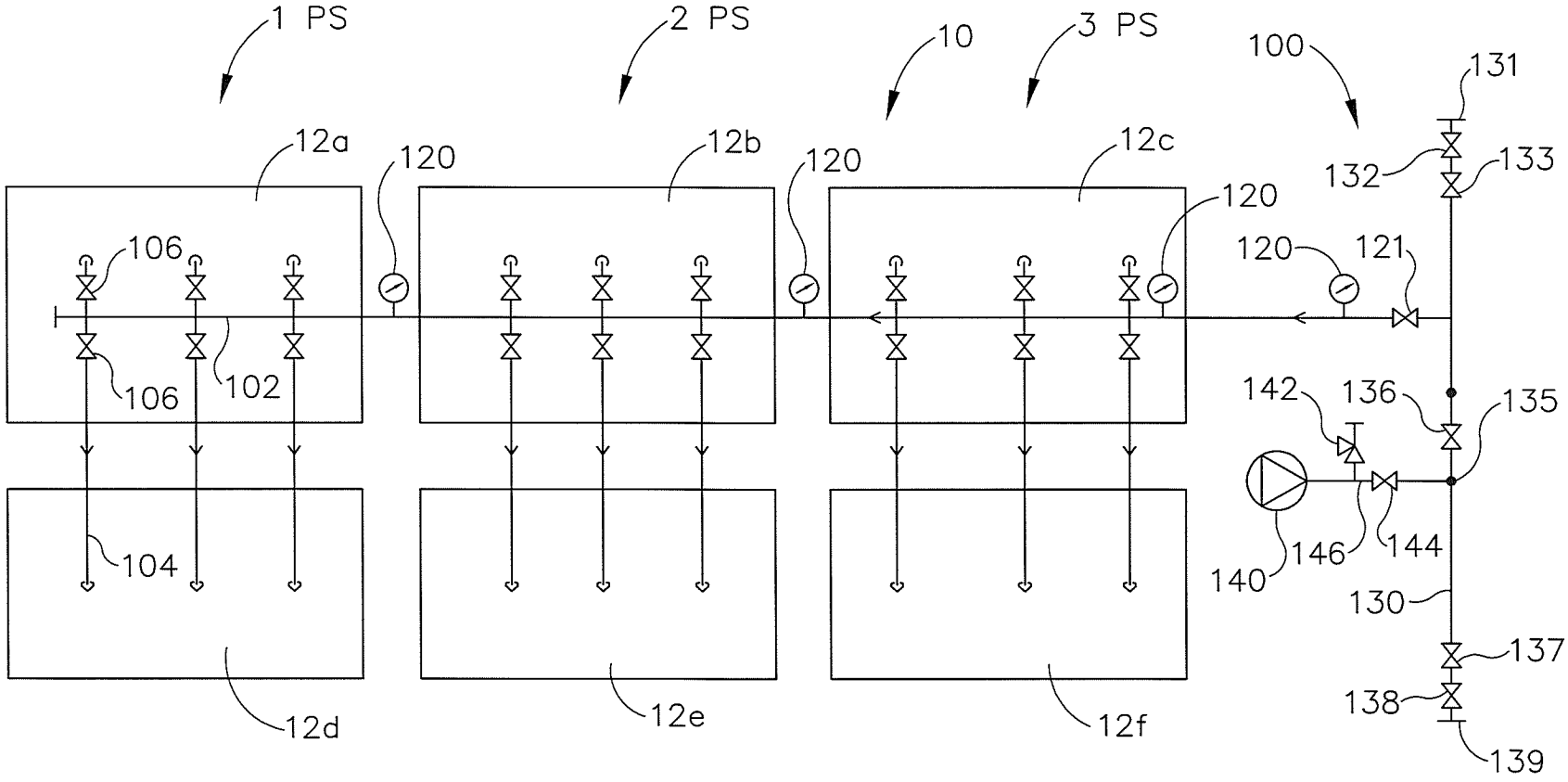
FIG. 4 depicts a schematic of the crude oil cargo recirculation system of FIG. 1.

As shown in FIG. 2, crude oil cargo recirculation system (10) comprises a longitudinal header (102), a recirculation header (104), and recirculation valves (106) coupled with a pumping unit (100). As shown in FIGS. 1 and 4, longitudinal header (102) is coupled with pumping unit (100) in the aft portion of tank barge (30) and extends longitudinally along the starboard portion tank barge (30) to the forward portion of tank barge (30). Of course, other suitable configurations for longitudinal header (102) will be apparent to one with ordinary skill in the art in view of the teachings herein. For example, longitudinal header (102) can extend along the port side of tank barge (30), centrally on tank barge (30), or obliquely along any portion of tank barge (30). Longitudinal header (102) of the present embodiment comprises a pipe having about a 10 inch diameter, but other suitable dimensions for longitudinal header (102) will be apparent to one with ordinary skill in the art in view of the teachings herein. Longitudinal header (102) thereby couples pumping unit (100) with a plurality of recirculation headers (104).

At least one recirculation header (104) is transversely coupled with longitudinal header (102) for each lateral row of tanks (1PS, 2PS, 3PS) such that a recirculation header (104) is configured to extend through each tank (12) in a lateral row of tanks (1PS, 2PS, 3PS). FIGS. 1 and 4 show each lateral row of tanks (1PS, 2PS, 3PS) including three recirculation headers (104). Recirculation headers (104) can be equally spaced along tank barge (30), or the distance between recirculation headers (104) can vary. For instance, each tank (12) can include three recirculation headers (104) spaced longitudinally equally along each tank (12) and such that an end of the recirculation header (104) is positioned on a geometric center of the tank (12). Recirculation header (104) of the present embodiment comprises a pipe having about a 6 inch diameter and a length of about 27 feet 4 inches. Of course, other suitable configurations, amount, and/or dimensions for recirculation headers (104) will be apparent to one with ordinary skill in the art in view of the teachings herein.

Figure 5:
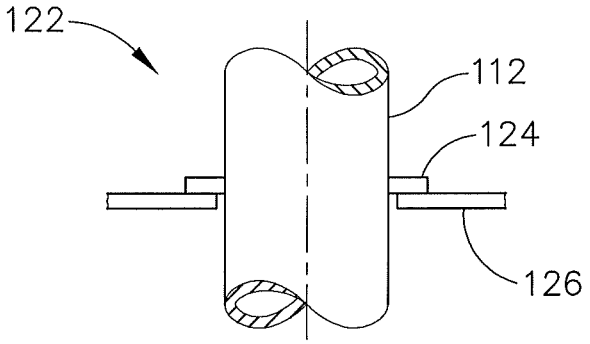
FIG. 5 depicts a side elevational view of an example deck penetration feature of the crude oil cargo recirculation system of FIG. 1.

Each recirculation header (104) comprises a pair of valves (106) positioned on each side of longitudinal header (102). Accordingly, a valve (106) is positioned between recirculation header (104) and each tank (12) in a lateral row of tanks (1PS, 2PS, 3PS) such that valve (106) is configured to selectively prevent the flow of oil through recirculation header (104) to an individual tank (12). Valves (106) can be 6 inch rising stem gate valves. As best seen in FIG. 2, each end of recirculation header (104) is then coupled to a pipe (112) that extends through deck (126) of tank barge (30) to within a tank (12). Pipes (112) comprise a deck penetration feature (122) to extend through deck (126). FIG. 5 shows deck penetration feature (122) in more detail. In the present embodiment, a plate (124) is positioned about pipe (112) and extends outwardly from pipe (112) by about 2¾ inches. Plate (124) can be similar to the thickness of deck (126). Plate (124) is then overlapped with deck (126) by about 2 inches. In some versions, plate (124) is positioned above deck (126) and is maintained in position against deck (126) by gravitational forces. In some other versions, plate (124) is secured to deck (126) by welding. Other suitable configurations for deck penetration feature (122) will be apparent to one with ordinary skill in the art in view of the teachings herein. Although FIG. 2 shows the piping of recirculation system (100) positioned above deck (126) of tank barge (30), recirculation system (100) can also be positioned below deck (126) of tank barge (30).

Pipes (112) further comprise a plurality of flanges (110) and a diffuser (118) positioned on the end of pipes (112) to diffuse the oil exiting pipes (112). Diffuser (118) can be a flanged fabricated cargo diffuser. Accordingly, the oil exiting diffuser (118) is dispersed to create a flow to resuspend material deposited on floors (16) of tanks (12). This causes the stirred material to mix with the remaining cargo oil within tanks (12) to decrease deposition of material and/or remove some or all of deposited material within tanks (12). In the present embodiment, diffuser (118) is positioned about 4 inches above a central portion of floor (16) of each tank (12). In other versions, diffusers (118) are offset within tanks (12). As will be apparent to one with ordinary skill in the art in view of the teachings herein, diffuser (118) can also be positioned at other suitable heights above floors (16). Pipes (112) of the present example are about 6 inches in diameter. Of course, other suitable configurations and dimensions for pipes (112) will be apparent to one with ordinary skill in the art in view of the teachings herein.

Pipes (112) of the present embodiment are supported within tanks (12) by support members (116). Support members (116) are coupled to floors (16) of tanks (12) to hold pipes (112) above floors (16). In the present example, two support members (116) are provided for each pipe (112) and comprise a pipe clamp that is mounted to pipes (112) about 4 feet above floors (16). Support member (116) then extends at about a 45 degree angle to floors (16) and is welded to floors (16). Of course, other suitable configurations for support members (116) will be apparent to one with ordinary skill in the art in view of the teachings herein.

Figure 3:
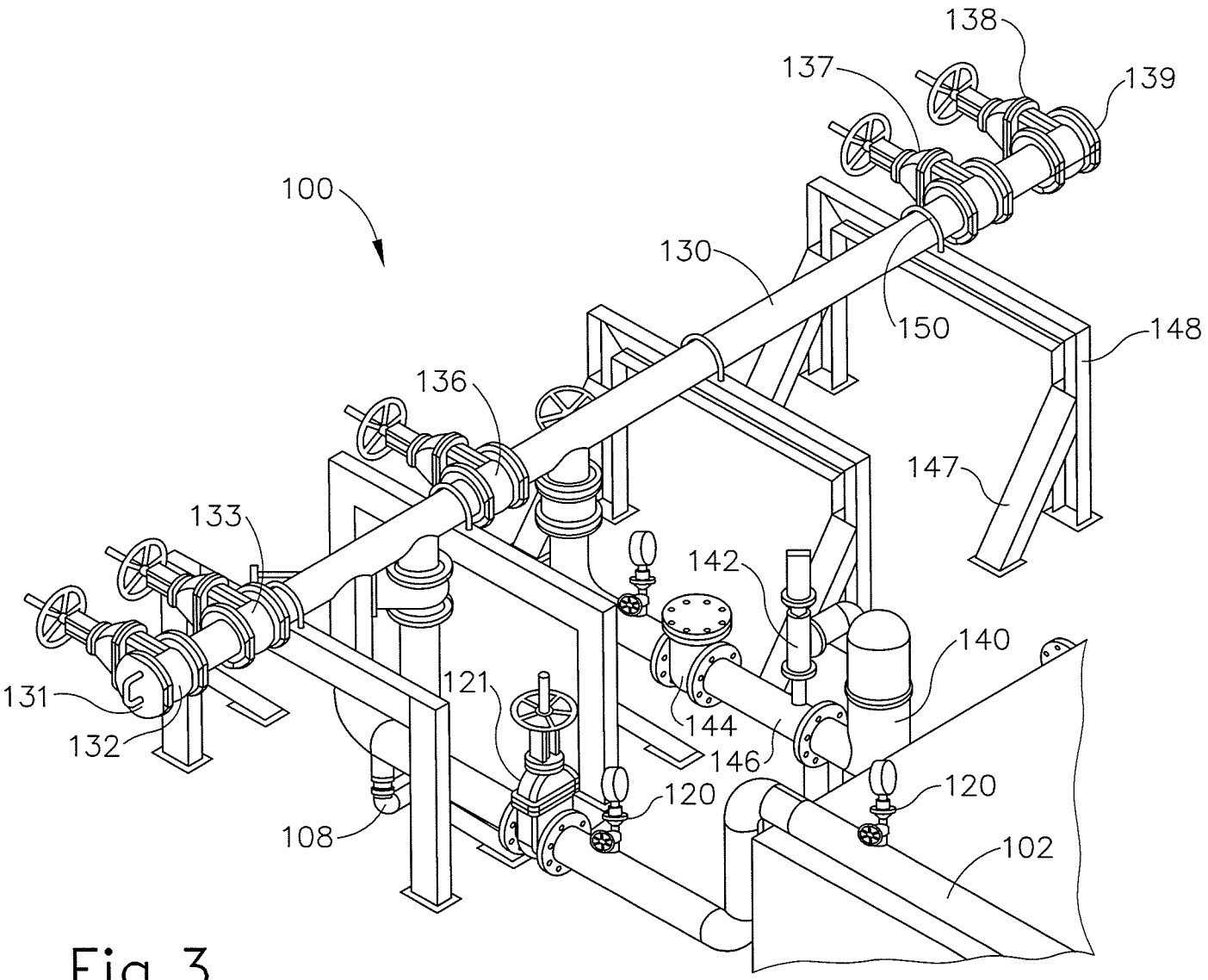
FIG. 3 depicts a partial perspective view of a pumping unit of the crude oil tank barge of FIG. 1 taken along line 3-3 of FIG. 1.

Cargo oil is recirculated to tanks (12) through longitudinal header (102) and recirculation headers (104) by pumping unit (100). FIGS. 3 and 4 show pumping unit (100) in more detail. Pumping unit (100) comprises a pump (140), a pressure relief valve (142), and a header (130). Pumping unit (100) can be provided with tank barge (30) as part of the cargo unloading system, or pumping unit (100) can be installed with recirculation system (10). Pump (140) of the present embodiment comprises a pump engine and is capable of pumping fluid at about 3,000 gallons per minute, but other suitable pump configurations can be used. Accordingly, pump (140) can be selectively actuated to pump cargo oil from within tanks (12) through cargo oil piping (not shown) below tanks (12), through pump (140) to header (130). Pump (142) is coupled with header (130) at connection point (135) via conduit (146). Header (130) and conduit (146) of the present embodiment comprise about 10 inch diameter pipes, although other suitably sized pipes can be used. Conduit (146) comprises a check valve (144) to selectively prevent oil from travelling through conduit (146) to header (130). Conduit (146) further comprises a pressure relief valve (142) positioned between pump (140) and check valve (144). Pressure relief valve (142) is configured to open when pressure in conduit (146) exceeds about 125 psi. Other suitable pressures will be apparent to one with ordinary skill in the art in view of the teachings herein.

When check valve (144) is in the open position, oil flows into header (130) from pump (140). Header (130) is then coupled to longitudinal header (102). A valve (136) is positioned on header (130) between where header (130)

couples with conduit (146) and longitudinal header (102). A second valve (121) is positioned on longitudinal header (102) between header (130) and tanks (12). Accordingly, valves (136, 121) can be block valves that are each independently configured to selectively prevent oil from flowing from pump (140) to tanks (12) through longitudinal header (102). A first end of header (130) comprises a blind flange (131) and a pair of valves (132, 133). A second end of header (130) also comprises a blind flange (139) and a pair of valves (137, 138), similar to the first end of header (130). Valves (132, 133, 137, 138) can be double rising stem valves. Accordingly, valves (132, 133, 137, 138) and/or blind flanges (131, 139) can be selectively opened to unload cargo oil from tanks (12) through header (130).

Figure 7:
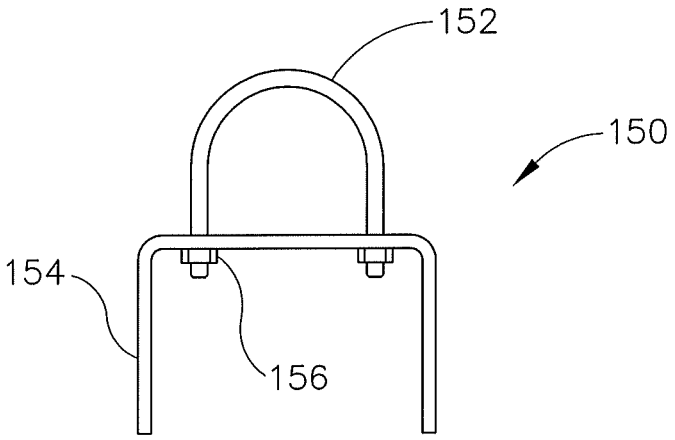
FIG. 7 depicts a side elevational view of an example pipe support of the crude oil cargo recirculation system of FIG. 1.

Header (130) and longitudinal header (102) can be secured to deck (126) by piping support (150) shown in FIG. 7. Piping support (150) comprises a u-bolt (152), a bar (154), and a nut (156). U-bolt (152) is positioned about the piping of header (130), longitudinal header (102), or other piping, and is inserted within openings of bar (154) such that u-bolt (152) and bar (154) surround the piping. Nuts (156) are then threaded onto u-bolt (152) to secure u-bolt (152) to bar (154) and to thereby secure the piping. Bar (154) is then secured to deck (126), or other support, to maintain the position of the piping. For instance, referring to FIG. 3, piping supports (150) of header (130) are coupled to a plurality of supports (148). Supports (148) comprise a support leg (147) and a piping support (150) positioned around header (130) to secure header (130) to supports (148). Supports (148) are secured to deck (126) to maintain the position of header (130). Other suitable configurations for supporting the piping will be apparent to one with ordinary skill in view of the teachings herein.

As further shown in FIG. 3, longitudinal header (102) comprises a drain line (108) coupled to longitudinal header (102) between header (130) and valve (121). Drain line (108) is then coupled with the cargo fill line piping and comprises a block valve (not shown) to selectively open drain line (108). Accordingly, drain line (108) is configured to drain longitudinal header (102) to the cargo fill line piping when the block valve is in the open position. Drain line (108) of the present example is configured to slope to the drain location such that drain line (108) is configured to drain by gravitational forces. Drain line (108) includes a pipe having about a 3 inch diameter. Of course, other suitable dimensions and configurations for drain line (108) will be apparent to one with ordinary skill in the art in view of the teachings herein.

Figure 6:
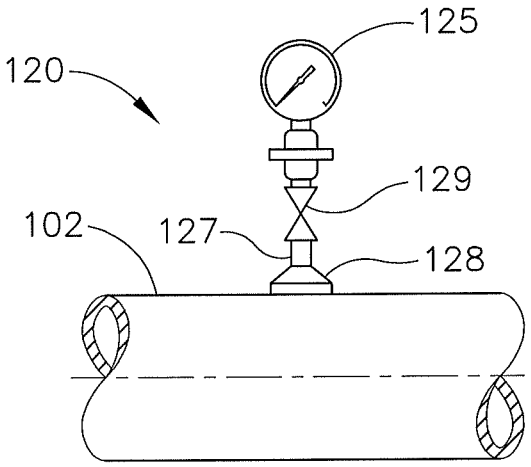
FIG. 6 depicts a side elevational view of an example pressure gauge of the crude oil cargo recirculation system of FIG. 1.

Referring to FIG. 4, a plurality of pressure gauges (120) are positioned along longitudinal header (102). In the present embodiment, a pressure gauge (120) is positioned after valve (121) and before each lateral row (1PS, 2PS, 3PS) of tanks (12). Pressure gauge (120) is shown in more detail in FIG. 6. Pressure gauge (120) comprises a gauge (125), a valve (129), a threadolet (127), and a nipple (128). Nipple (128) is coupled with longitudinal header (102) and comprises about a ½ inch diameter. Threadolet (127) is then welded to nipple (128) with about a ¼ inch weld. Threadolet (127) comprises about a ½ inch diameter and is coupled with valve (129). Valve (129) comprises about a ½ inch diameter and is coupled with gauge (125) to selectively allow flow to gauge (125). Gauge (125) is then configured to display the pressure within longitudinal header (102) near the position of pressure gauge (120). If pressure gauge (120) indicates that the pressure within longitudinal header (102) exceeds a desired amount, flow to longitudinal header (102) can be automatically or manually decreased or stopped. Other suitable dimensions, positions, and configurations for pressure gauge (120) will be apparent to one with ordinary skill in the art in view of the teachings herein.

II. Example Operation of A Crude Oil Cargo Recirculation System

Figure 8:
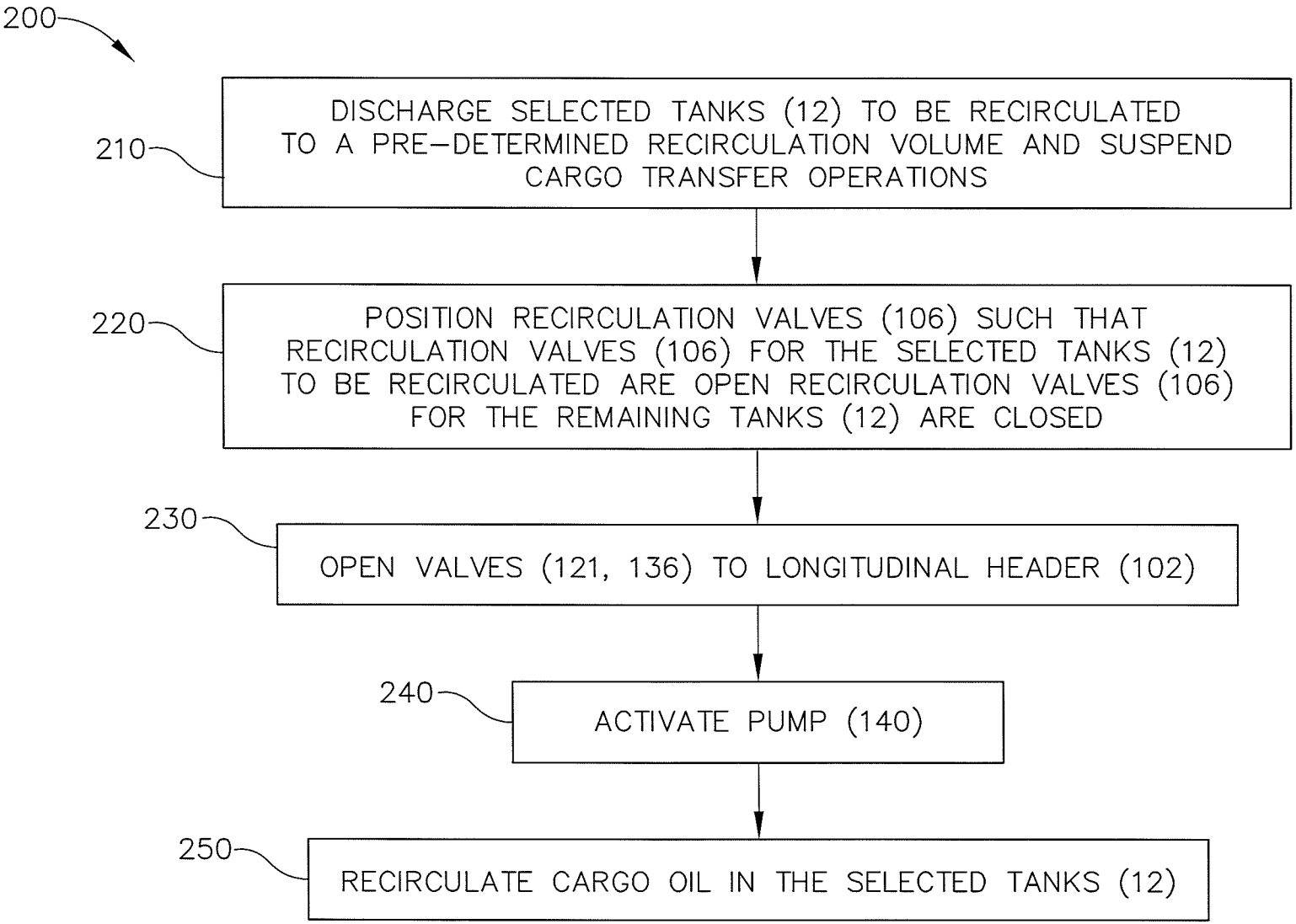
FIG. 8 depicts a flowchart of an example operation of the crude oil cargo recirculation system of FIG. 1.

Cargo recirculation system (10) can be actuated to recirculate cargo oil within select tanks (12) of tank barge (30) to decrease and/or remove the amount of build-up material deposited in tanks (12). This recirculation system (10) can also be used with any other type of cargo that tends to settle. FIG. 8 shows an example method (200) of operation for recirculation system (10). To operate recirculation system (10), the desired tanks (12) to be recirculated can be discharged to a pre-determined recirculation volume, such as approximately 50% volume, and cargo transfer operations can be suspended (block 210). Accordingly, blind flanges (131, 139) and valves (132, 133, 137, 138) of header (130) can be opened to allow oil to discharge from each select tank (12) through header (130) to set the desired volume of each select tank (12). Blind flanges (131, 139) and/or valves (132, 133, 137, 138) of header (130) can then be closed to prevent oil from discharging through header (130) to suspend cargo transfer operations. The cargo fill block valve (not shown) can also be closed.

Recirculation valves (106) are then positioned such that recirculation valves (106) are closed in all tanks (12), except for select tanks (12) being recirculated (block 220). In the present example, cargo recirculation is conducted for each lateral row (1PS, 2PS, 3PS) of tanks (12) individually. Accordingly, to recirculate lateral row (1PS) of tanks (12*a*, 12*d*), recirculation valves (106) for lateral row (1PS) are opened, while recirculation valves (106) of lateral rows (2PS, 3PS) are closed. After lateral row (1PS) has been recirculated, recirculation valves (106) for lateral row (2PS) are opened and recirculation valves (106) for lateral rows (1PS, 3PS) are closed to recirculate lateral row (2PS). Recirculation valves (106) for lateral row (3PS) are then opened and recirculation valves (106) for lateral rows (1PS, 2PS) are closed to recirculate lateral row (3PS). Alternatively, any number of tanks (12) can be recirculated in any suitable order. For example, tanks (12) can be recirculated individually, or multiple tanks (12) can be recirculated simultaneously. For tanks (12) being simultaneously recirculated, valves (106) and/or valve (121) are merely optional.

Once recirculation valves (106) are in the desired position, vent stack is raised and vent valve (not shown) is opened. Valve (121) of longitudinal header (102) is then opened (block 230) and pump (140) is activated (block 240). Pump (140) then recirculates cargo oil from the selected tanks (12) (block (250) by pumping cargo oil from the select tank (12) through the cargo piping (not shown) to header (130). Cargo oil then flows to recirculation headers (104) through longitudinal header (102). Where recirculation valves (106) are open, cargo oil flows through recirculation header (104) and pipes (112), out of diffusers (118), and back into the select cargo tank (12) where the oil was pumped from. This stirs material deposited on floors (16), or elsewhere within tanks (12), to mix with the remaining cargo oil within tank (12). Accordingly, the deposited material within tanks (12) is decreased and/or removed. The cargo oil can be recirculated for about 15 to about 30 minutes. Of course, other suitable amounts of time will be apparent to one with ordinary skill in the art in view of the teachings herein.

During recirculation, the liquid levels within tanks (12) can be monitored periodically for liquid levels. Vessel trim can be periodically inspected to confirm that the trim remains unchanged throughout the recirculation operation.

The cargo level within tanks (12) does not rise during the recirculation operation in the present example such that the cargo level remains below the 1 meter level. Alternatively, the cargo level can increase and/or decrease during the recirculation process. Other suitable cargo levels will be apparent to one with ordinary skill in the art in view of the teachings herein. If a cargo leak is detected, the cargo level changes within a tank (12), or other abnormal conditions occur during the recirculation process, the recirculation process can be stopped. For instance, any combination of valves (144, 136, 121, 106) can be closed to prevent oil from flowing through longitudinal header (102) to recirculation headers (104).

When the recirculation process is complete, pump (140) can be deactivated and/or disengaged and recirculation valves (106) can be opened to allow residual cargo oil remaining in the piping to drain to tanks (12). Drain line (108) can also be opened to allow residual cargo oil to drain to the cargo fill line. When the residual oil is drained from the recirculation piping, recirculation valves (106) and valve (121) can be closed.

Example 1

Figure 9:
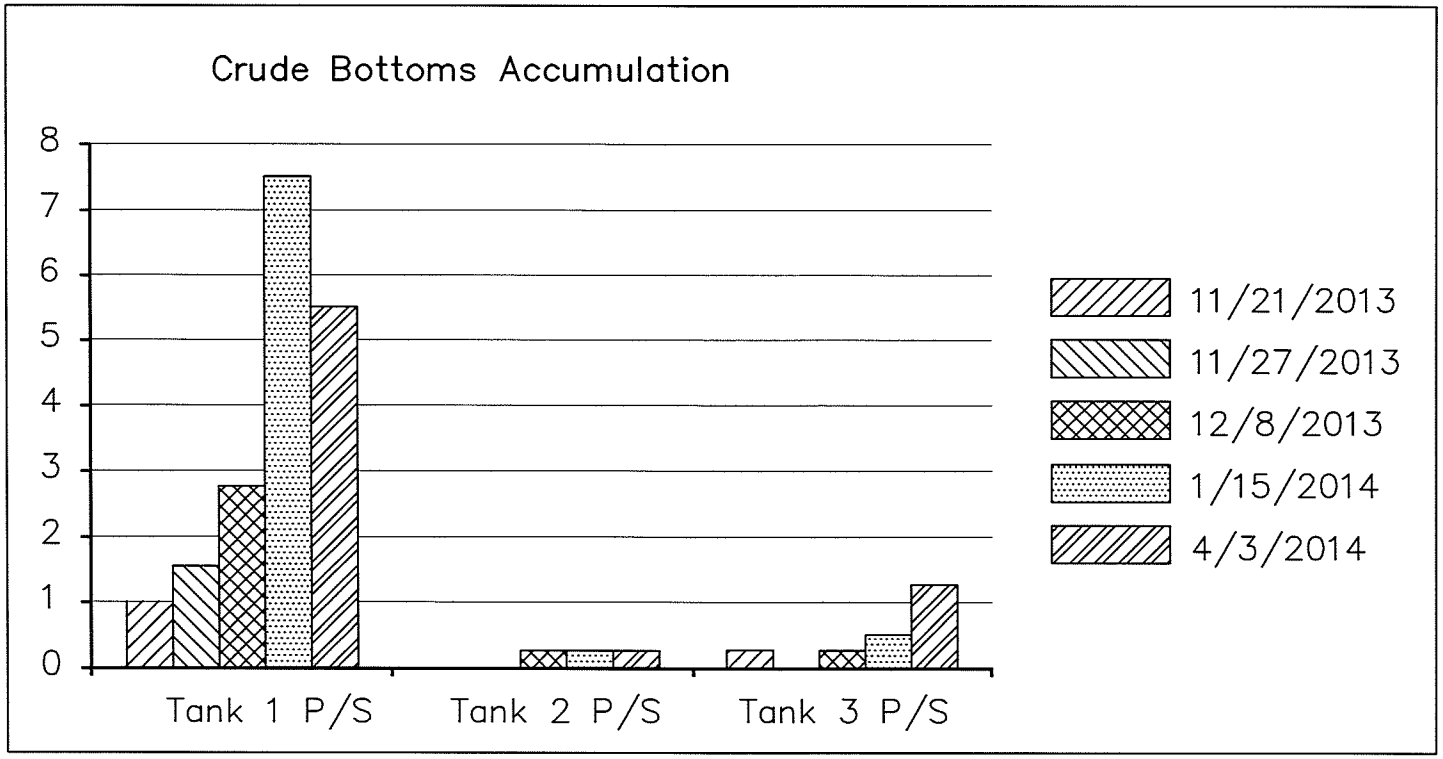
FIG. 9 depicts a graph of an example deposit accumulation in cargo tanks of the crude oil cargo recirculation system of FIG. 1.

FIG. 9 shows an example accumulation of material build-up within tanks (12). The amount of deposited material was measured in each tank (12). Tanks (12*a*, 12*d*) of lateral row (1PS) had an accumulation of build-up of about 1 inch. Tanks (12*b*, 12*e*, 12*c*, 12*f*) of lateral rows (2PS, 3PS) had an accumulation of build-up of less than an inch. Tanks (12*b*, 12*e*, 12*c*, 12*f*) of lateral rows (2PS, 3PS) were then recirculated using the recirculation system (10) and method described above, while tanks (12*a*, 12*d*) of lateral row (1PS) were not recirculated. The amount of deposited material was again measured about one week later. The accumulation of build-up in tanks (12*b*, 12*e*, 12*c*, 12*f*) of lateral rows (2PS, 3PS) remained below 1 inch, while the accumulation of build-up in tanks (12*a*, 12*d*) of lateral row (1PS) increased to over 1 inch. Tanks (12*b*, 12*e*, 12*c*, 12*f*) of lateral rows (2PS, 3PS) were again recirculated using the recirculation system (10) and method described above, while tanks (12*a*, 12*d*) of lateral row (1PS) were not recirculated. The amount of deposited material was again measured about 17 days after the first measurement. The accumulation of build-up in tanks (12*b*, 12*e*, 12*c*, 12*f*) of lateral rows (2PS, 3PS) remained below 1 inch, while the accumulation of build-up in tanks (12*a*, 12*d*) of lateral row (1PS) increased to over 2 inches. This recirculation process was repeated, and about 8 weeks after the first measurement, the accumulation of build-up in tanks (12*b*, 12*e*, 12*c*, 12*f*) of lateral rows (2PS, 3PS) remained below 1 inch, while the accumulation of build-up in tanks (12*a*, 12*d*) of lateral row (1PS) increased to over 7 inches.

After the fourth measurement, tanks (12*a*, 12*d*) of lateral row (1PS) were recirculated along with tanks (12*b*, 12*e*) of lateral row (2PS). Tanks (12*c*, 12*f*) of lateral row (3PS) were not recirculated. The accumulation of build-up in tanks (12*a*, 12*d*) was reduced to just above 5 inches. The accumulation of build-up in tanks (12*b*, 12*e*) of lateral row (2PS) remained under 1 inch, while the accumulation of build-up in tanks (12*c*, 12*f*) of lateral row (3PS) increased to above 1 inch. This shows that recirculation system (10) is operable to decrease the amount of build-up deposited within tanks (12) of a crude oil tank barge (30) to thereby increase the capacity of tanks (12).

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A recirculation system for a crude oil cargo tank barge having at least one tank, wherein the recirculation system comprises:

a pump in fluid communication with the at least one tank; and recirculation piping in fluid communication with the pump and the at least one tank, wherein the recirculation piping extends through the at least one tank such that an exit of the recirculation piping is positioned adjacent and towards a bottom surface of the at least one tank;

wherein the pump is actuatable to pump fluid from the at least one tank to the recirculation piping, wherein the recirculation piping is operable to return the pumped fluid to the at least one tank without further processing the fluid, wherein the pumped fluid returned to the at least one tank from the exit of the recirculation piping is operable to remove deposits built-up on the bottom surface of the at least one tank by diffusing the fluid in the at least one tank adjacent and towards the bottom surface of the at least one tank, wherein the pumped fluid is crude oil.

2. The recirculation system of claim 1, wherein the recirculation piping comprises at least one valve operable to selectively prevent fluid from flowing through the recirculation piping to the at least one tank.

3. The recirculation system of claim 2, wherein the recirculation piping comprises a valve positioned upstream of each tank such that the recirculation piping is operable to selectively recirculate fluid to each tank.

4. The recirculation system of claim 1, wherein the recirculation piping comprises a first header and at least one second header coupling the first header with the at least one tank.

5. The recirculation system of claim 4, the first header extending longitudinally along a length of the tank barge.

6. The recirculation system of claim 4, wherein the first header comprises the at least one valve to selectively prevent fluid from flowing through at least a portion of the first header from the pump.

7. The recirculation system of claim 6, wherein the at least one second header further comprises at least one valve operable to selectively prevent fluid from flowing through the second header to the at least one tank.

8. The recirculation system of claim 4, wherein the at least one tank comprises three second headers.

9. The recirculation system of claim 1, wherein the recirculation piping comprises a diffuser positioned at an exit of the recirculation piping to the at least one tank, wherein the diffuser is operable to diffuse the fluid exiting the recirculation piping.

10. The recirculation system of claim 9, wherein the diffuser is positioned about 4 inches above a floor of the at least one tank.

11. The recirculation system of claim 1, wherein the recirculation piping comprises at least one pressure gauge operable to display the pressure within at least a portion of the recirculation piping.

12. The recirculation system of claim 1, further comprising a pressure relief valve positioned between the pump and the recirculation piping.

13. The recirculation system of claim 1, wherein the recirculation piping is positioned above a deck of the tank barge such that the recirculation piping is configured to extend through the deck to the at least one tank.

14. The recirculation system of claim 13, wherein the portion of the recirculation piping extending through the deck comprises a deck penetration feature operable to maintain the position of the recirculation piping relative to the deck.

15. The recirculation system of claim 1, wherein the recirculation system is operable to decrease the amount of build-up within the at least one tank.

16. A method of operating a recirculation system for recirculating crude oil within a cargo tank barge having a plurality of tanks, wherein the recirculation system comprises a pump and recirculation piping coupling the pump with at least one of the tanks of the plurality of tanks, the method comprising the steps of:

setting the volume each tank of the plurality of tanks to be recirculated to a pre-determined recirculation volume;

actuating the pump to pump fluid from at least one of the tanks of the plurality of tanks to be recirculated to the recirculation piping;

returning the fluid through the recirculation piping adjacent and towards deposits built-up on a surface of at least one of the tanks of the plurality of tanks to be recirculated such that the fluid is subject to no further processing, wherein the fluid is returned with a force sufficient to remove the deposits built-up on the surface of the at least one tank of the plurality of tanks to be recirculated.

17. The method of claim 16, wherein returning the fluid comprises diffusing the fluid into the tanks.

18. The method of claim 16, wherein the recirculation piping comprises a valve positioned upstream of each tank of the plurality of tanks, wherein the method further comprises selecting each tank of the plurality of tanks to be recirculated by positioning each valve to selectively recirculate fluid to each tank.

19. The method of claim 18, wherein the plurality of tanks form a plurality of lateral rows, wherein selecting each tank of the plurality of tanks to be recirculated comprises selecting a lateral row to be recirculated.

20. A recirculation system for a crude oil cargo tank barge having a plurality of tanks, wherein the recirculation system comprises recirculation piping in fluid communication with each tank of the plurality of tanks, wherein the recirculation piping comprises at least two recirculation pipes, wherein each recirculation pipe has an exit, wherein each tank of the plurality of tanks comprises at least two recirculation pipes such that the at least two exits of the at least two recirculation pipes are longitudinally aligned along a central portion of each tank of the plurality of tanks, wherein the recirculation system is operable to recirculate fluid from within each tank of the plurality of tanks through the recirculation piping and back into the tanks without further processing the fluid, wherein the recirculation piping comprises a plurality of valves to selectively recirculate fluid within the plurality of tanks.

* * * * *